United States Patent [19]

Stahl et al.

[11] 4,093,071

[45] June 6, 1978

[54] NESTING AND STACKING CONTAINER

[75] Inventors: Edward L. Stahl, Richmond, Mich.; Ellsworth E. Sanders, Sanibel Island, Fla.

[73] Assignee: Pinckney Molded Plastics, Inc., Pinckney, Mich.

[21] Appl. No.: 784,145

[22] Filed: Apr. 4, 1977

[51] Int. Cl.[2] ..... B65D 21/04

[52] U.S. Cl. ..... 206/507; 206/518

[58] Field of Search ..... 206/505, 506, 507, 518

[56] References Cited

U.S. PATENT DOCUMENTS

| | | | |
|---|---|---|---|
| 3,387,740 | 6/1968 | Bockenstette | 206/505 |
| 3,392,875 | 7/1968 | Bockenstette | 220/66 |
| 3,780,905 | 12/1973 | Herolzer | 206/507 |

*Primary Examiner*—George E. Lowrance

[57] ABSTRACT

The container disclosed herein is adapted to nest in a similarly oriented lower container of identical construction when turned 90° with respect thereto. The container is also adapted to stack at a higher level in the lower container when similarly oriented or when turned 180°. The container has a substantially square bottom wall, side walls extending substantially vertically upwardly from opposite sides edges of the bottom wall, an open front, and a nesting support bar extending across the rear of the container in spaced relation above the bottom wall to define an open space between the bottom wall and the support bar. The container is nested with the lower container by engaging the support bar over the upper edge of one of the side walls of the lower container and resting the front portion of the container on seating means provided on the other side wall of the lower container. The side walls also have stacking rails or ribs along their upper edges and complementary stacking grooves in the bottom wall so that the container may be slid to a stacked position across a lower container of identical construction.

8 Claims, 18 Drawing Figures

NESTING AND STACKING CONTAINER

SUMMARY OF THE INVENTION

The container of this invention is adapted to either nest or stack with another container of identical construction. One of the features of the invention is that the container is substantially square both inside and out even when stacked or nested with other containers. It is important that the inside area of the bottom wall retain its substantially full square dimensions even when the container is nested or stacked so that its carrying capacity is not reduced. This is accomplished by the unique construction of the container.

In accordance with the present invention, the container has side walls projecting upwardly from the opposite side edges of its substantially square bottom wall. The front is open and the rear has a horizontal nesting support bar disposed in spaced relation above the bottom wall. When the container is turned 90° and nested with a lower container of identical construction, the nesting support bar engages over the upper edge of either one of the side walls of the lower container and the front portion of the container rests upon seats provided on the other side wall. The side wall of the lower container upon which the nesting support bar of the upper container rests projects upwardly into the space between the bottom wall of the upper container and its nesting support bar. The opposite side wall of the lower container closes the open front of the upper container. Thus the side walls of the lower container substantially close the open front and rear of the upper container without reducing the inside area thereof.

In accordance with other objects of the invention, the container is designed so that it may stack at an upper level on rails provided on the side walls of a lower container. The container has complementary grooves in its underside so that it may be slid to a stacked position when similarily oriented with respect to the lower container or when turned end for end.

Other objects and features of the invention will become more apparent as this description proceeds, especially when taken in conjunction with the accompanying drawings, wherein.

Figure 1:
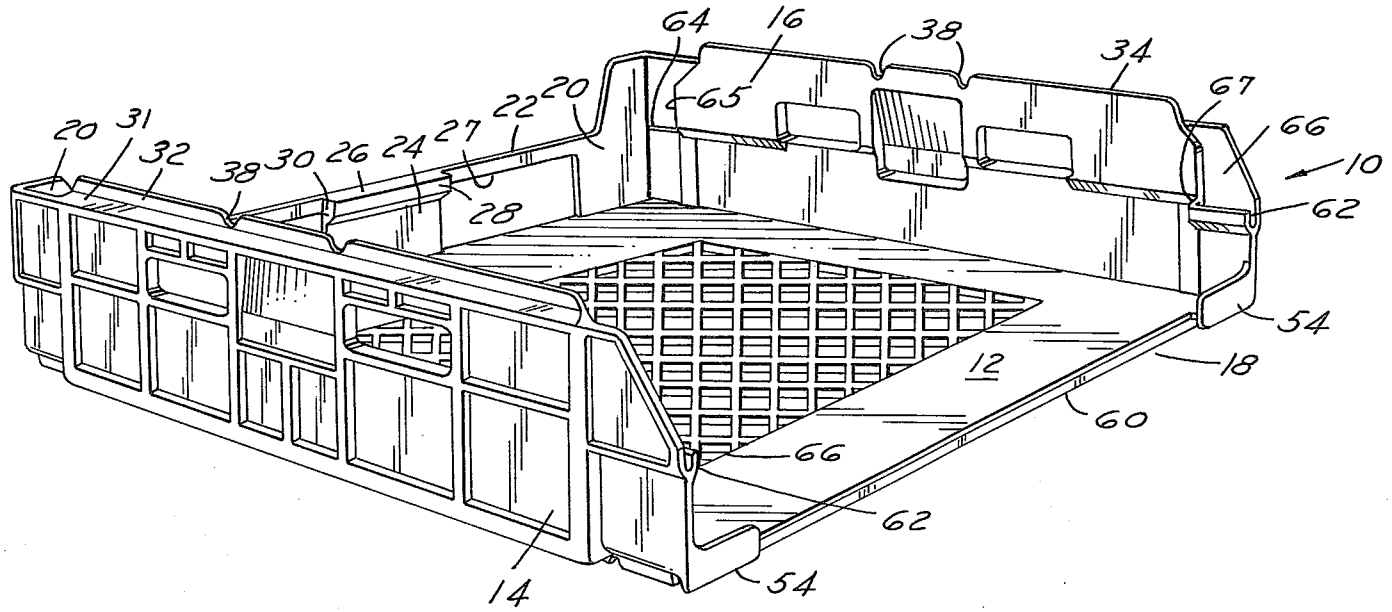
FIG. 1 is a perspective view of a container constructed in accordance with our invention.
Figure 2:
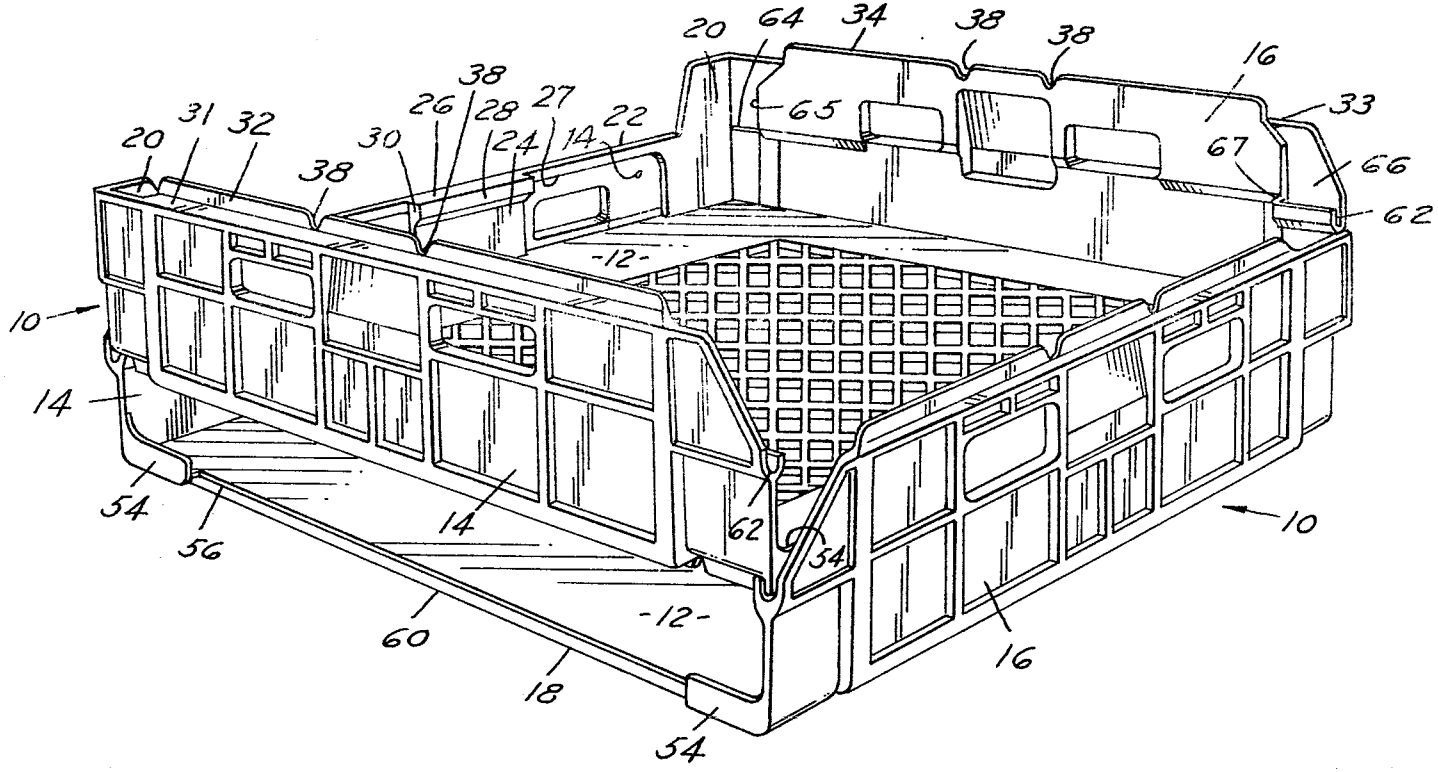
FIG. 2 is a perspective view showing the container of FIG. 1 nested with another container of identical construction.

Referring now more particularly to the drawings, the container is of generally square form and is designated by the numeral 10. All of the containers shown in the several views are of identical construction. The containers may be formed of any suitable material, preferably plastic, such as molded polyethylene or polypropylene. They may be used for any purpose but are designed primarily as bakery containers for bread, cakes, rolls and the like.

The container 10 has a substantially square horizontal bottom wall 12. The major portion of the surface area of the bottom wall is shown as being of an open crossing-grid construction which is not necessary insofar as the invention is concerned but which has the advantage of lightening the structure and also making it easier to clean and hence kept in a sanitary condition.

The container has the upright parallel side walls 14 and 16 extending substantially vertically upwardly from opposite side edges of the bottom wall. The front 18 of the container is substantially completely open. The rear of the container has at each corner the substantially vertically upwardly extending rear wall portions 20 which are provided primarily to strengthen the container, and a horizontally extending nesting support bar 22 extending from one rear wall portion 20 to the other. The support bar is spaced above the bottom wall 12 a distance less than the side wall height, in this instance about one-half such height, to define an open space 27 at the rear. The rear edge of the bottom wall is recessed slightly where indicated at 23 beneath the support bar 22 and between the wall portions 20.

The rear wall structure of the container also includes a center reinforcing member of strip 24 which extends upwardly from the rear edge of the bottom wall to the horizontal support bar about midway between the opposite side edges of the container to bisect the open space 27. It is connected to the horizontal support bar by a horizontal flange 26 which extends forwardly from its connection with the support bar and then is turned downwardly at 28 where it merges into the major portion of the strip. The ends of these horizontal and vertical portions 26 and 28 are closed by portions 30.

Figure 10:
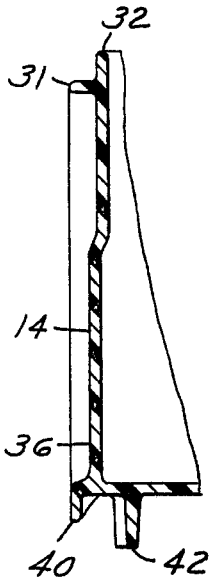
FIG. 10 is a fragmentary sectional view taken on the line 10—10 in FIG. 3.
Figure 11:
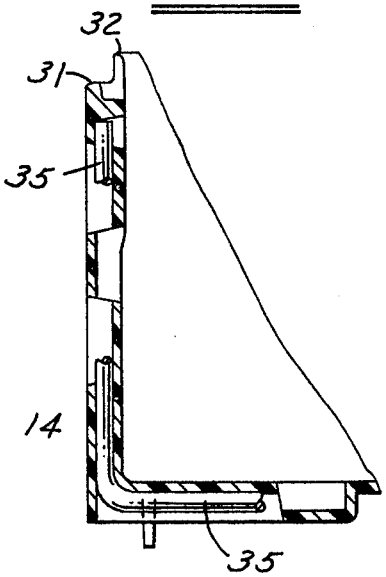
FIG. 11 is a fragmentary sectional view taken on the line 11—11 in FIG. 3.
Figure 12:
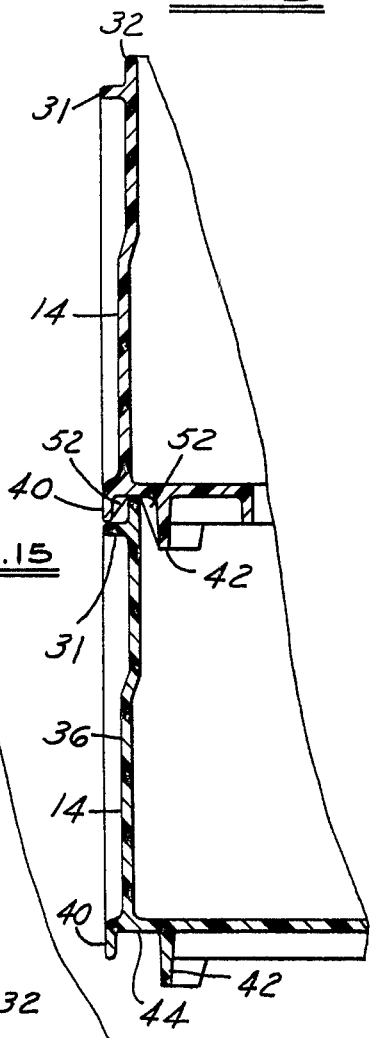
FIG. 12 is a fragmentary sectional view in the plane of FIG. 10 showing the container stacked with another container of identical construction.
Figure 15:
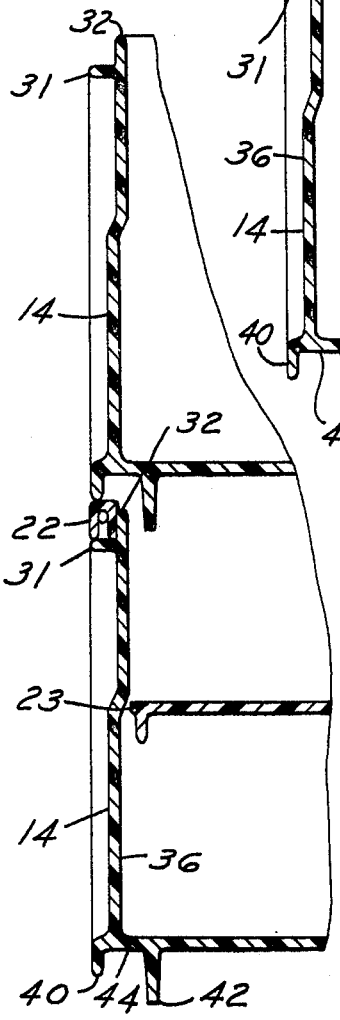
FIG. 15 shows three nested containers in fragmentary section with the section of the lower and upper containers being in the same plane as FIG. 10.
Figure 13:
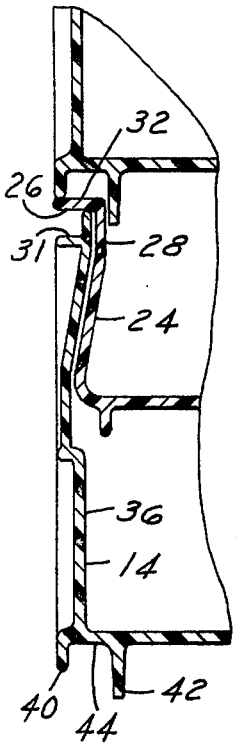
FIG. 13 shows a fragmentary section of three nested containers in which the section of the lower container is in the same plane as FIG. 8.
Figure 14:
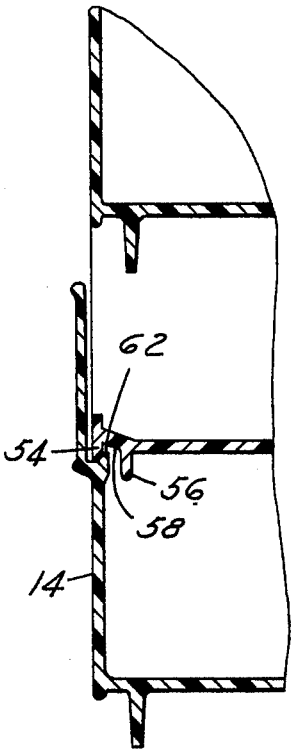
FIG. 14 shows three nested containers in fragmentary section, the section of the lower container being taken on the line 14—14 in FIG. 3.
Figure 16:
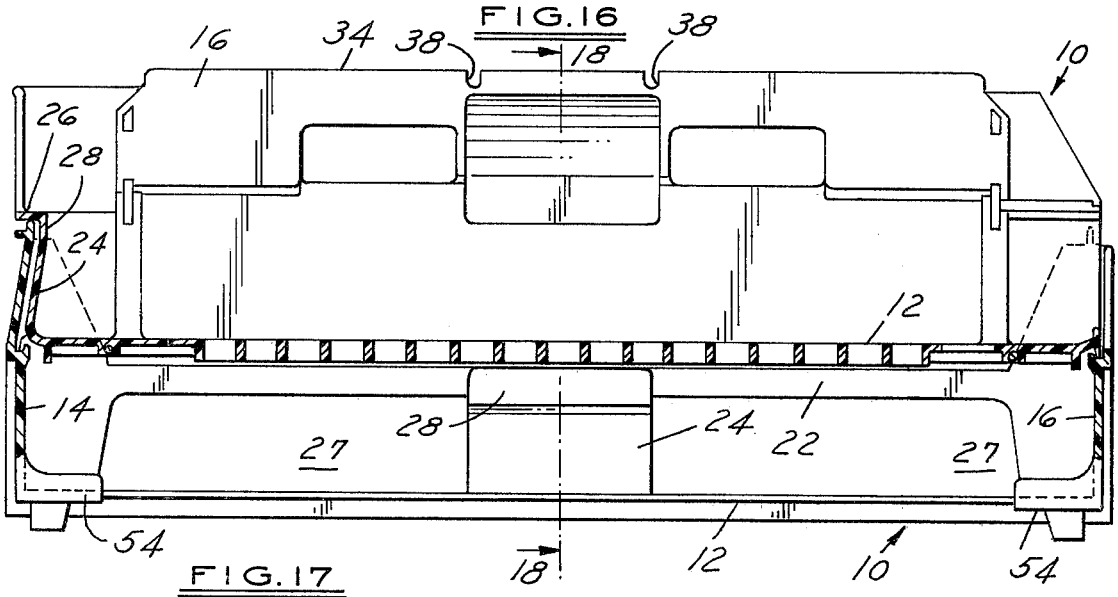
FIG. 16 is a view partially in elevation and partially in section showing two nested containers.

The side walls of the container are mirror images of one another and as stated extend substantially vertically upwardly from the bottom wall. The upper edges of the side walls are defined by the horizontal flanges or ledges 31 and 33. Horizontal stacking rails or ridges 32 and 34 project upwardly from the inner edge portions of the ledges 31 and 33 and are displaced inwardly slightly from the lower portions 36 of the side walls as may be seen for example in FIGS. 10, 12 and 15. The rails of course are parallel and extend for a major portion of the full length of the side walls but terminate short of the front and rear of the container. The rails also have notches or interruptions 38, a pair of which are provided in each such rail in spaced apart relation in the center portion thereof for a purpose which will become more apparent hereinafter. The side walls may be reinforced by rods 35 if desired.

Figure 17:
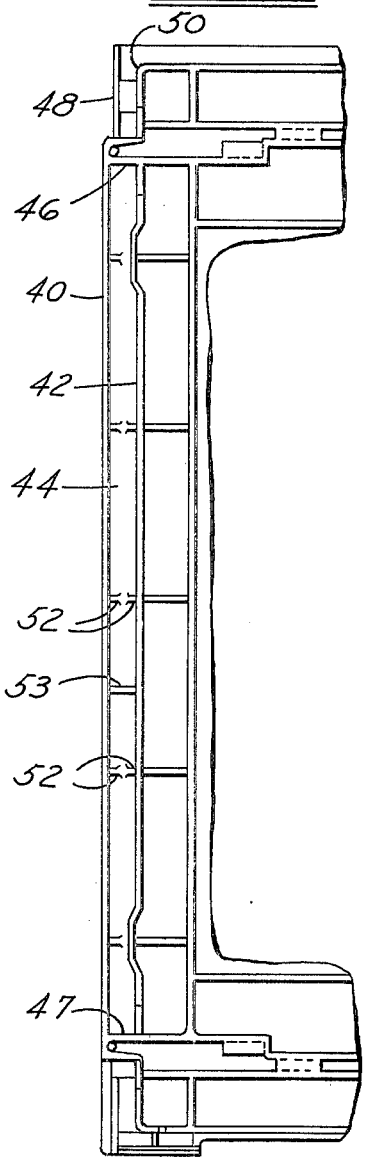
FIG. 17 is a fragmentary bottom view of the container.
Figure 18:
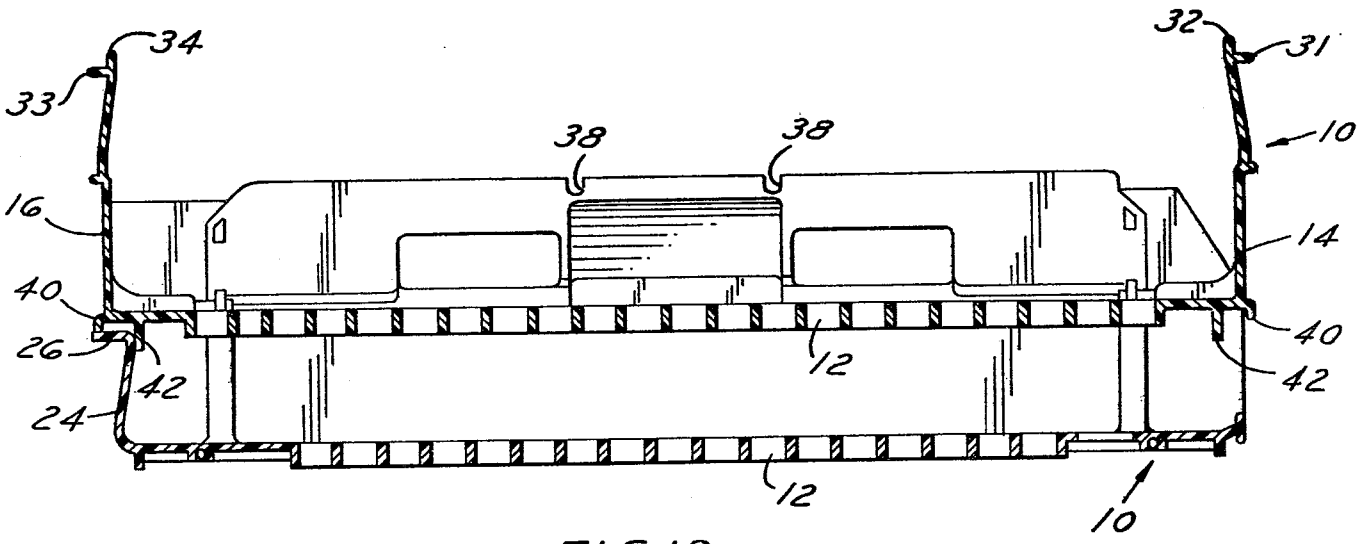
FIG. 18 is a sectional view taken on the line 18—18 in FIG. 16.

The underside of the bottom wall 12 of the container is formed along each side edge with a pair of laterally spaced parallel ribs 40 and 42, each pair of ribs defining a downwardly opening groove 44 (see FIG. 17). The grooves 44 on opposite sides of the container are parallel and are spaced apart the same distance as the stacking rails 32 and 34. These grooves are closed at the opposite ends by the downwardly extending transverse walls or webs 46 and 47 which are spaced apart a distance equal to or slightly greater than the length of the rails 32 and 34. At the rear of the container on each side thereof, the underside of the bottom wall is provided with the spaced parallel pilot ribs 48 and 50 which extend more or less in continuation of the ribs 40 and 42 to form a pilot groove for the rear of the container when it is slid across the rails to a stacking condition as will become more apparent hereinafter. Inclined opposed pairs of webs 52 at spaced points along the grooves are provided to engage the rail when engaged therein to prevent lateral play of a stacked container. (see FIG. 12). A web 53 extends across each groove intermediate its ends and is adapted to engage in one of the notches 38 in the stacking rail of a stacked container.

Further with respect to the bottom wall of the container, it will be noted that at the front thereof there are a pair of aligned laterally spaced downwardly extending flanges 54 which are disposed near the side walls and provide feet for supporting the container when nested with a second container. These flanges 54 are parallel to and cooperate with a transverse rib 56 also extending across the front of the container beneath the bottom wall to define downwardly opening grooves 58. It will be noted that between the ribs 54, the front of the bottom wall is cut back or recessed slightly where indicated at 60.

Each side wall of the container is provided with a pair of seats 62 and 64 for supporting the feet 54 of a nested container. The seat 62 is at the front of the container intermediate the upper and lower edges of the side wall and is defined by an upwardly extending flange 66 spaced inward from the side wall to provide a U-shaped recess in contact with the horizontal bottom of which the lower edge of the foot 54 of an upper container is adapted to engage when nested. The recess is closed at the rear by a wall 67. The bottom of the recess of seat 62 is in horizontal alignment with the horizontal shelf that defines the seat 64 at the rear of the container. Seat 64 extends to wall 65 at one end and, as shown in FIG. 1, may if desired be extended around the corner and along the rear wall portion 20 of the container. The lower edge of the other foot 54 of a nested container rests on seat 64.

The container is adapted to stack upon a second container of identical construction when it is either similarly oriented or turned 180°, that is end for end, with respect thereto. When similarly oriented, the upper container is held at a level above the lower container and the grooves between the pilot flanges 48,50 are engaged with the forward portions of the stacking rails 32 and 34. The upper container may be held at a slight angle at this time with its front end elevated with respect to its rear end. The upper container may then be slid rearwardly across the lower container, gradually lowering the upper container during the sliding movement into a horizontal positon in which its grooves 44 engage the rails 32 and 34. Actually, the grooves will not fully engage the rails but rather the transverse webs 46 and 53 slide on the rails until the upper container is disposed directly over the lower container. Ribs 42 depend beneath rails 32 and 34 during sliding on, to guide the upper container. When the upper container is directly over the lower container, it will drop causing the rails 32 and 34 to extend fully up into the grooves 44. At this time each web 53 will fit into one of the notches 38. Webs 46, 47 and 53 retain the upper container against forward and rearward movement from the fully stacked position. Webs 52 prevent lateral shifting.

The container when reversed end for end with respect to a lower container will stack in the same manner. When thus stacked, each web 53 will fit into the other notch 38. Although no pilot grooves and flanges (similar to grooves and flanges 48,50) are provided at the front for this purpose, obviously, they may be if desired. However, normally the containers are not stacked reversely oriented. Usually the containers are stacked in a similarly oriented relationship with all containers open at the front so that the contents are readily visible.

The container is adapted to nest with a second container of identical construction when it is turned 90° with respect thereto in either direction. The upper container is held above the lower container in crossing relation and the rear of the upper container is lowered to bring its nesting support bar 22 to rest upon the upper edge or flange 31 or 33 of one of the side walls thereof outwardly of its stacking rail. The front of the upper container is then lowered, turning about its nesting support bar as a pivot, until the feet 54 at the front thereof come to rest on the seats 62 and 64 on the opposite side wall of the lower container. The center strip 24 extends over the inner surface of the side wall of the lower container with the horizontal flange 26 over the top of the stacking rail and the portions 30 in the notches 38. The upper container is now fully nested in the lower container with its bottom wall disposed in spaced parallel relation above the bottom wall of the lower container.

Figure 3:
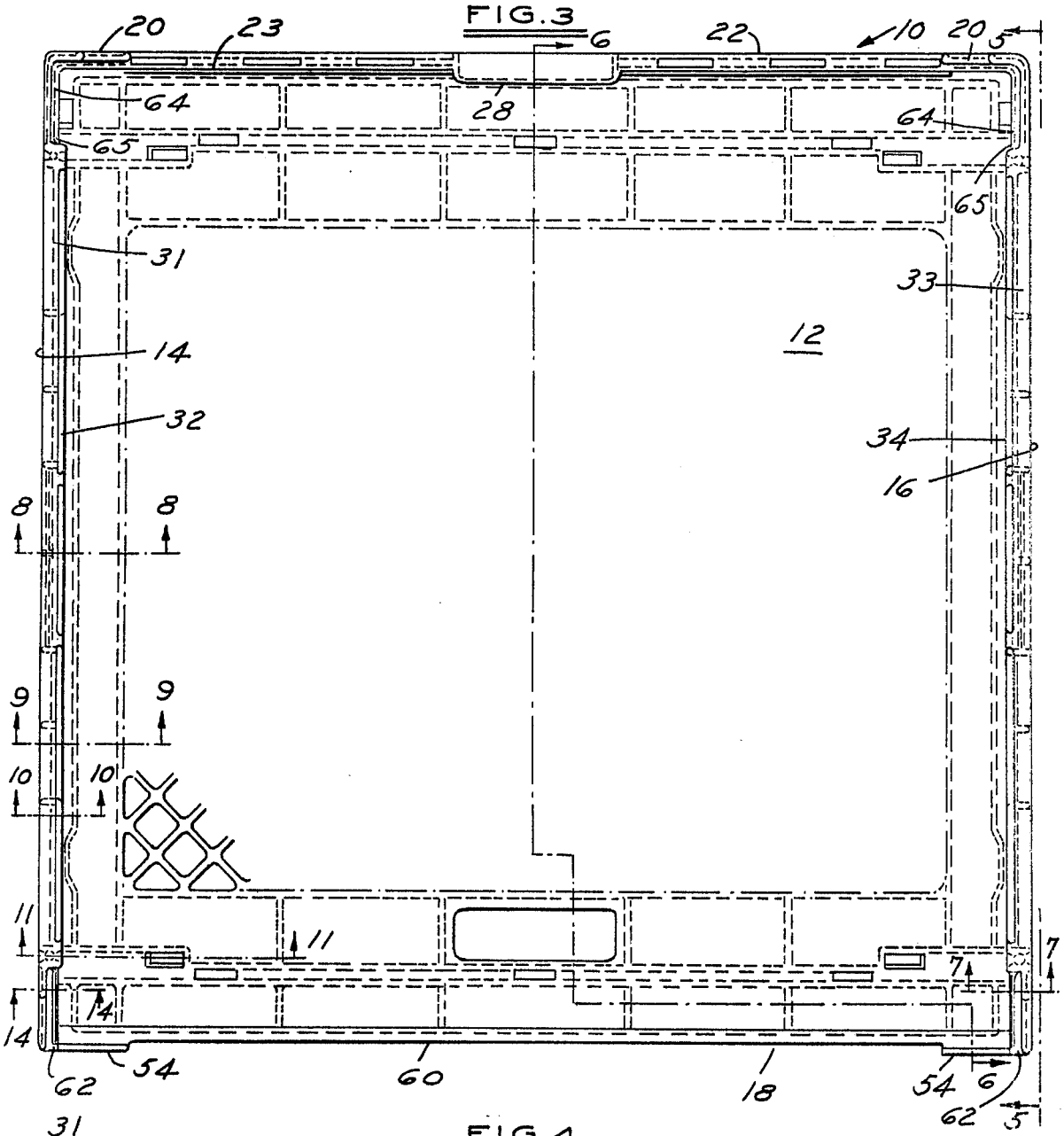
FIG. 3 is a top plan view of the container.
Figure 4:
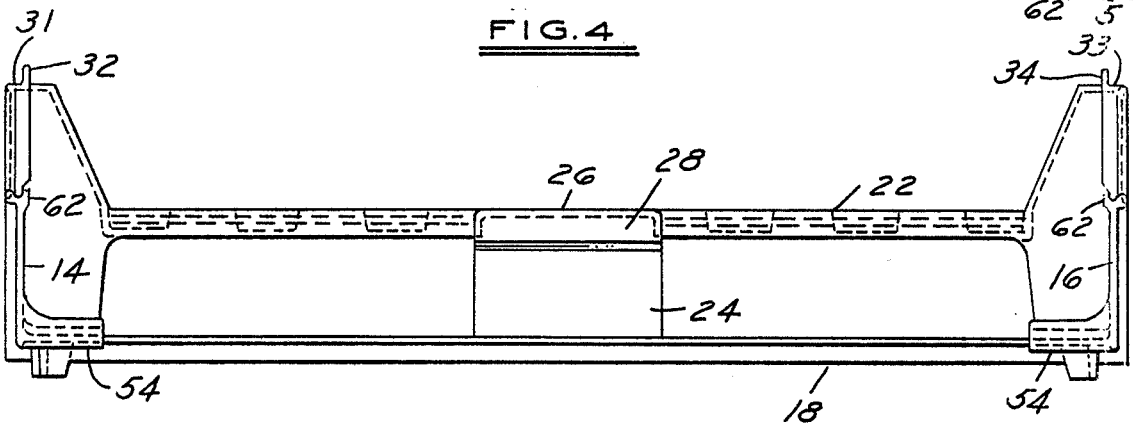
FIG. 4 is a front view of the container.
Figure 5:
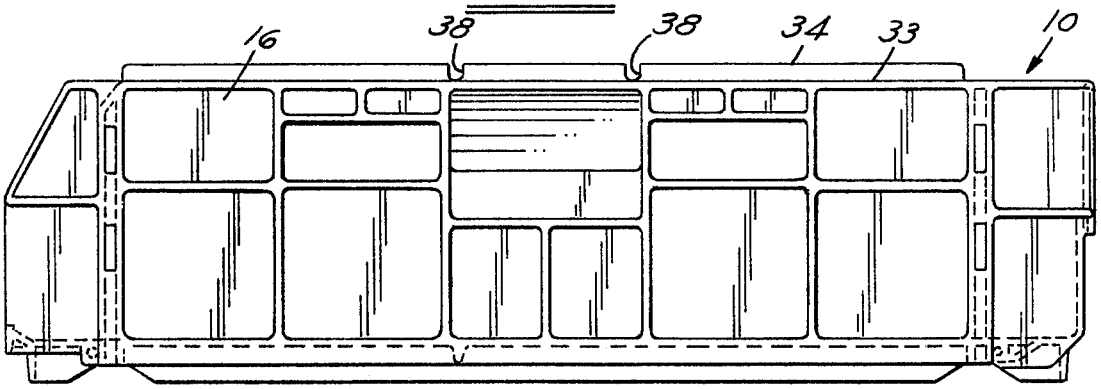
FIG. 5 is a side view of the container.
Figure 6:
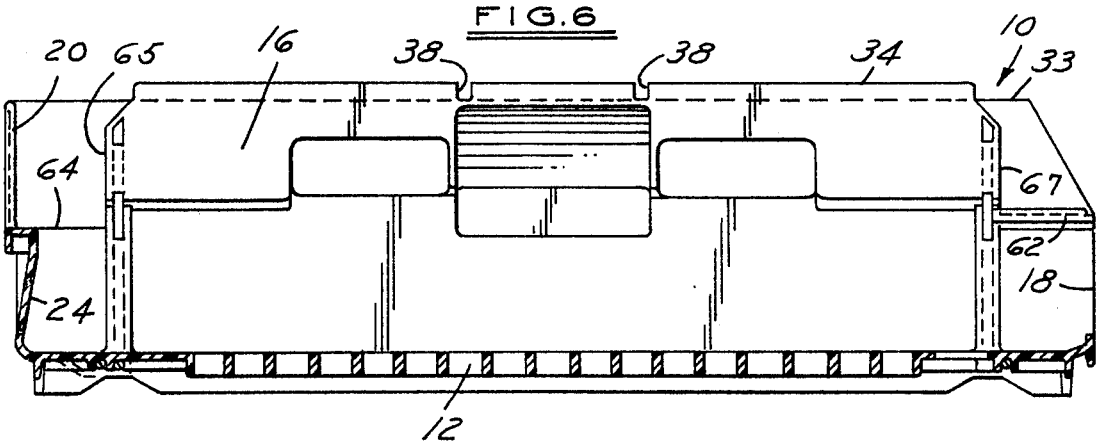
FIG. 6 is a sectional view taken on the line 6—6 in FIG. 3.
Figure 7:
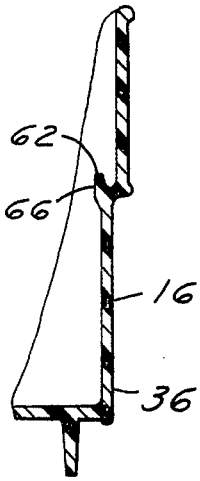
FIG. 7 is a fragmentary sectional view taken on the line 7—7 in FIG. 3.
Figure 8:
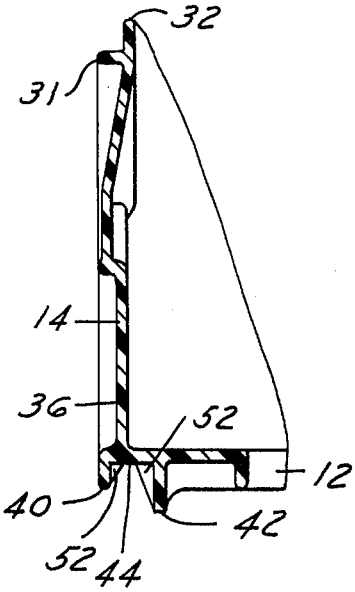
FIG. 8 is a fragmentary sectional view taken on the line 8—8 in FIG. 3.
Figure 9:
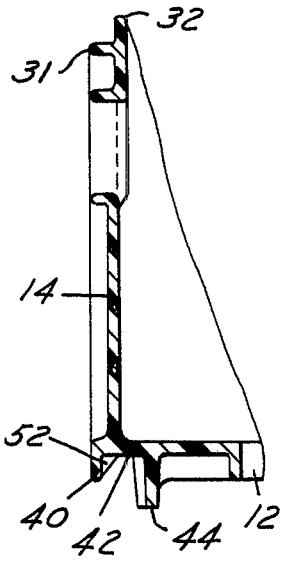
FIG. 9 is a fragmentary sectional view taken on the line 9—9 in FIG. 3.

In this nested condition, the two side walls of the upper container provide boundaries on two sides of its bottom wall while the other two sides of the bottom wall are bounded by the side walls of the lower container. As seen in FIG. 3, the upper portion of one side wall of the lower container extends across the open front of the upper container while the upper portion of the other wall of the lower container extends across the open rear of the upper container. Actually, such other side wall of the lower container projects into the open space 27 between the bottom wall of the upper container and its nesting support bar in the plane of its rear wall portions 20. The slight recesses at the front and rear of the bottom wall of the upper container, while not absolutely necessary, clear the side walls of the lower container to make for easier nesting. Since the containers are identical, and since the area of the bottom wall of the nested container is bounded on two sides by its own side walls and on the other sides by the side walls of the lower container, obviously the full square dimensions of the bottom wall are retained for carrying merchandise even in the nested relationship of the parts.

The stack of nested containers may be continued upwardly within reason to whatever height desired, with each nested container having the same full bottom wall supporting area for its contents. When nested, the containers may support buns or rolls or any relatively low lying products. Higher baked goods such as bread and cakes might require stacking of the containers instead of nesting.

When nested, the two sides of the lower container prevent the upper container from shifting in one direction. Shifting in the other direction is prevented along the rear of the upper container by its portions 30 which engage notches 38 of the lower container and by its rear wall portions 20 which engage the ends of the side walls of the lower container. Shifting in the other direction is prevented along the front of the upper container by its feet 54 engaging the walls 65 and 67 of the side wall of the lower container.

Also when nested, the support bar 22 of the lower container is disposed under the side edge portion of the upper container. It is not needed necessarily to support the upper container, but may assist in that function.

What we claim as our invention is:

1. An upwardly open container comprising a substantially square horizontal bottom wall, side walls extending upwardly from opposite side edges of said bottom wall, first seating means adjacent the upper edge portion of one of said side walls, second seating means on the other of said side walls, a horizontal nesting support member extending across the rear of said container, rest means at the front of said container, said container being adapted to nest with a 90° turned lower container of identical construction by engaging said support member of the upper container with said first seating means of the lower container and engaging said rest means of the upper container with said second seating means of the lower container, said support member being disposed at a level above said bottom wall and below said first seating means, said second seating means being disposed at a level below said first seating means in a position to maintain the bottom wall of an upper nested container parallel with the bottom wall of the lower container.

2. An upwardly open container comprising a substantially square horizontal bottom wall, an open front, side walls extending upwardly from opposite side edges of said bottom wall, first seating means adjacent the upper edge portion of one of said side walls, second seating means on the other of said side walls, a horizontal nesting support bar extending across the rear of said container, rest means at the front of said container, said container being adapted to nest with a 90° turned lower container of identical construction by engaging said support bar of the upper container with said first seating means of the lower container and engaging said rest means of the upper container with said second seating means of the lower container, said support bar being disposed at a level below said first seating means and spaced above the said bottom wall to define an open space between said support bar and said bottom wall such that when said container is nested as aforesaid with a 90° turned lower container of identical construction the said one side wall of the lower container projects upwardly into said open space to close the rear of the upper container and said other side wall of the lower container projects upwardly across the open front of the upper container to close the same, said second seating means being disposed at a level below said first seating means in a position to maintain the bottom wall of an upper nested container parallel with the bottom wall of the lower container.

3. The container defined in claim 2, wherein the rear edge portion of said bottom wall is recessed to clear said one side wall of a nested lower container.

4. The container defined in claim 2, wherein the front edge portion of said bottom wall is recessed to clear said other side wall of a nested lower container.

5. The container defined in claim 2, wherein the upper edges of said side walls have elongated rails, said container having grooves on the underside directly beneath said rails so that said container can be slid to a stacked position with respect to another similarly or reversely oriented container of identical construction by engaging the rails of the one with the grooves of the other.

6. The container defined in claim 2, including third seating means adjacent the upper edge portion of the said other of said side walls at the same level as said first seating means, fourth seating means on the said one of said side walls at the same level as said second seating means, whereby said container is adapted to nest with a 90° turned lower container of identical construction by engaging said support bar of the upper container with said third seating means of the lower container and engaging said rest means of the upper container with said fourth seating means of the lower container.

7. The container defined in claim 6, wherein said first and third seating means have elongated rails, said container having grooves on the underside directly beneath said rails so that said container can be slid to a stacked position with respect to another similarly or reversely oriented container of identical construction by engaging the rails of the one with the grooves of the other.

8. The container defined in claim 7, wherein said rails have notches therein, notch-engaging means on said support bar, the notch-engaging means of said container when nested with a lower container having portions extending into said notches of the lower container.

* * * * *